US006064846A

United States Patent [19]

Wang et al.

[11] Patent Number: 6,064,846

[45] Date of Patent: May 16, 2000

[54] DEVELOPER CONTAINER INCLUDING FLANGE FOR SUPPORTING CONTAINER ON FLAT SURFACE

[75] Inventors: Jui-Chi Wang; Robin Hsu; Ya-Li Huang; Kuan-Tung Li, all of Taichung, Taiwan

[73] Assignee: General Plastic Industrial Co., Ltd., Taichung, Taiwan

[21] Appl. No.: 09/373,024

[22] Filed: Aug. 11, 1999

[51] Int. Cl.[7] ..... G03G 15/08

[52] U.S. Cl. ..... 399/262; 222/DIG. 1

[58] Field of Search ..... 399/262, 119, 399/258, 263, 120, 222; 222/DIG. 2

[56] References Cited

U.S. PATENT DOCUMENTS 5,235,389 8/1993 Kikuchi et al. ..... 399/260
5,508,794 4/1996 Ikesue et al. ..... 399/260
5,528,349 6/1996 Satake ..... 399/260
5,794,108 8/1998 Yoshizawa et al. ..... 399/262
5,797,073 8/1998 Russell ..... 399/260
5,828,935 10/1998 Tatsumi et al. ..... 399/260

*Primary Examiner*—William Royer
*Assistant Examiner*—Remmon R. Forde'
*Attorney, Agent, or Firm*—Pro-Techtor International Service

[57] ABSTRACT

A developer container having a spiral groove around the periphery, a developer supply hole at one end, two protruding positioning strips raised from the periphery at two opposite sides of the developer supply holes an annular flange at an opposite end for enabling the developer container to be put on a flat surface in vertical, two opposed notches formed on the annular flange, and two toothed blocks respectively suspended in the notches for engagement with respective toothed blocks at a driving shaft in an electrophotographic image forming apparatus for synchronous rotation with the driving shaft.

1 Claim, 4 Drawing Sheets

DEVELOPER CONTAINER INCLUDING FLANGE FOR SUPPORTING CONTAINER ON FLAT SURFACE

BACKGROUND OF THE INVENTION

The present invention relates to a developer container for use with a developer replenishing device in a copier, facsimile apparatus, printer or similar electrophotographic image forming apparatus, and more particularly to such a developer container which has an annular flange at a rear end thereof for supporting the developer container on a flat surface in vertical, and two toothed blocks suspended in two opposed notches at the annular flange for engagement with respective toothed blocks at a driving shaft in an electrophotographic image forming apparatus for synchronous rotation with the driving shaft.

A developer container for use with a developer replenishing device in a copier, facsimile apparatus, printer or similar electrophotographic image forming apparatus, as shown in FIGS. 1 and 2 (U.S. Pat. No. 5,828,935), generally comprises a substantially cylindrical container body A, and a positioning block B for securing the container body A to a developer container rack in an electrophotographic image forming apparatus. The container body A comprises a protruded coupling flange A1 at a rear end thereof, and a coupling groove A2 around the periphery of the protruded coupling flange A1. Before fastening the positioning block B to the container body A, the container body A cannot be put on a flat surface in vertical for the loading of developer. Further, the container body A is molded from polyethylene, and the positioning block B is molded from acrylonitrile-butadienestyrene. When fastened together, the container body A and the positioning block B cannot be detached from each other. After use, it is difficult to reclaim the waste developer container.

SUMMARY OF THE INVENTION

The present invention has been accomplished to provide a developer container, which eliminates the aforesaid problems. It is one object of the present invention to provide a developer container, which can be used with any of a variety of copiers, facsimile apparatus, printers or similar electrophotographic image forming apparatus. It is another object of the present invention to provide a developer container, which can be put on a flat surface in vertical, convenient for the loading of developer. According to one aspect of the present invention, the developer container comprises a container body having an annular flange at a rear end thereof for supporting the developer container on a flat surface in vertical. According to another aspect of the present invention, the container body comprises two toothed blocks suspended in two opposed notches at the annular flange thereof for engagement with respective toothed blocks at a driving shaft in an electrophotographic image forming apparatus for synchronous rotation with the driving shaft.

DETAILED DESCRIPTION OF THE PREFERRED EMBODIMENT

Figure 1:
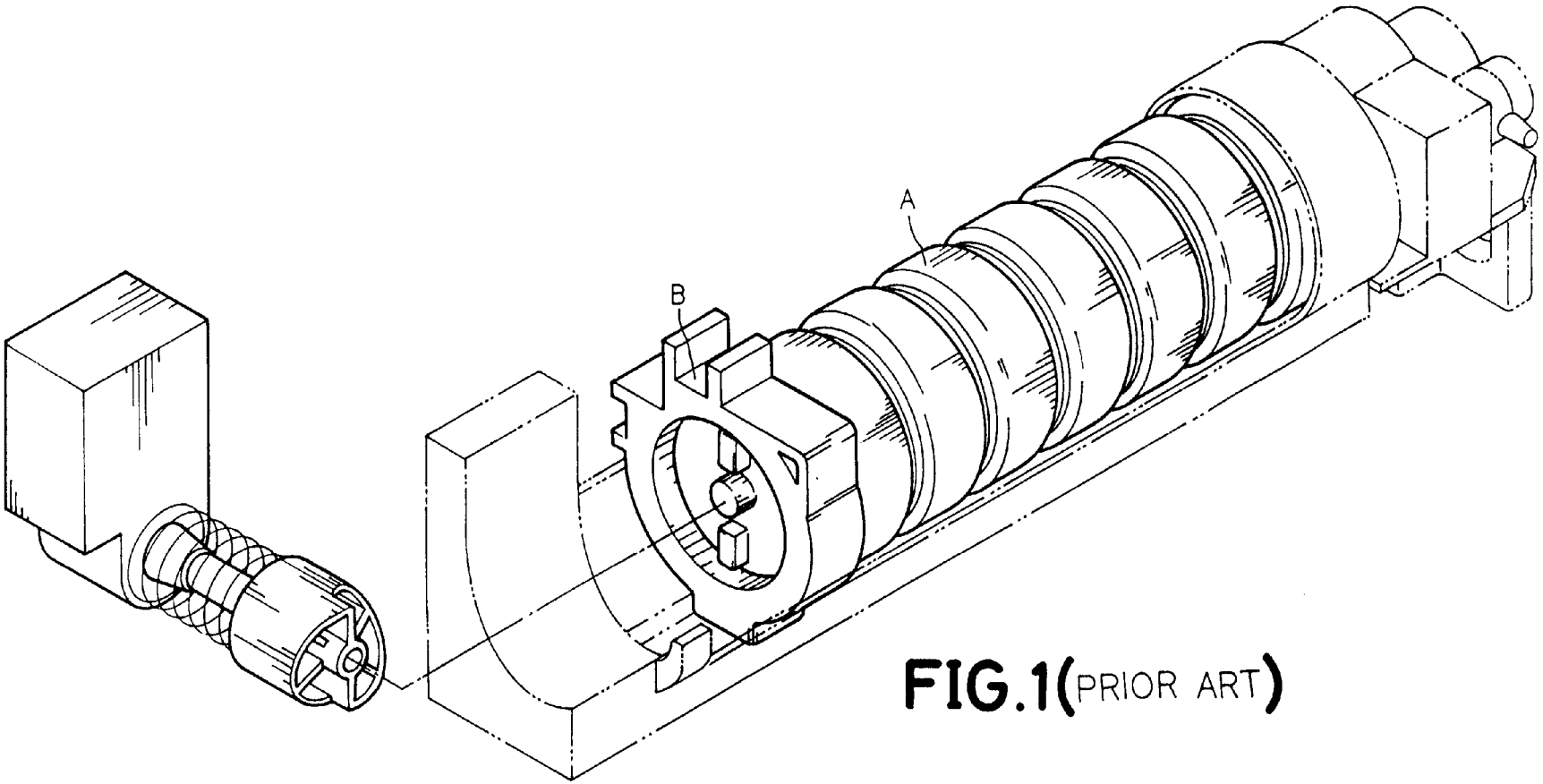
FIG.1(PRIOR ART)
FIG. 1 is a perspective view of a developer container according to the prior art.
Figure 2:
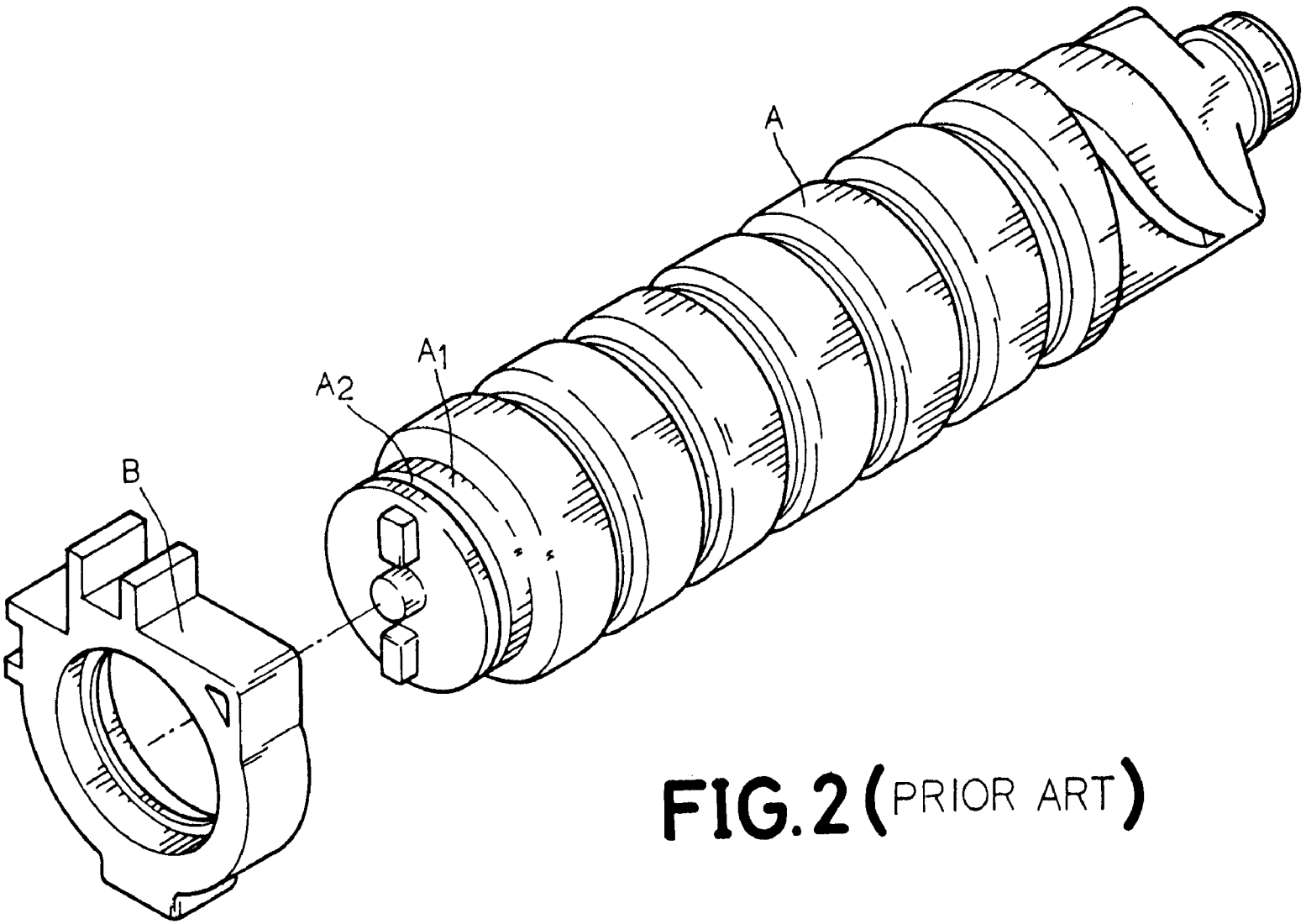
FIG. 2 (PRIOR ART)
FIG. 2 is a perspective view of an end cap according to the prior art.
Figure 3:
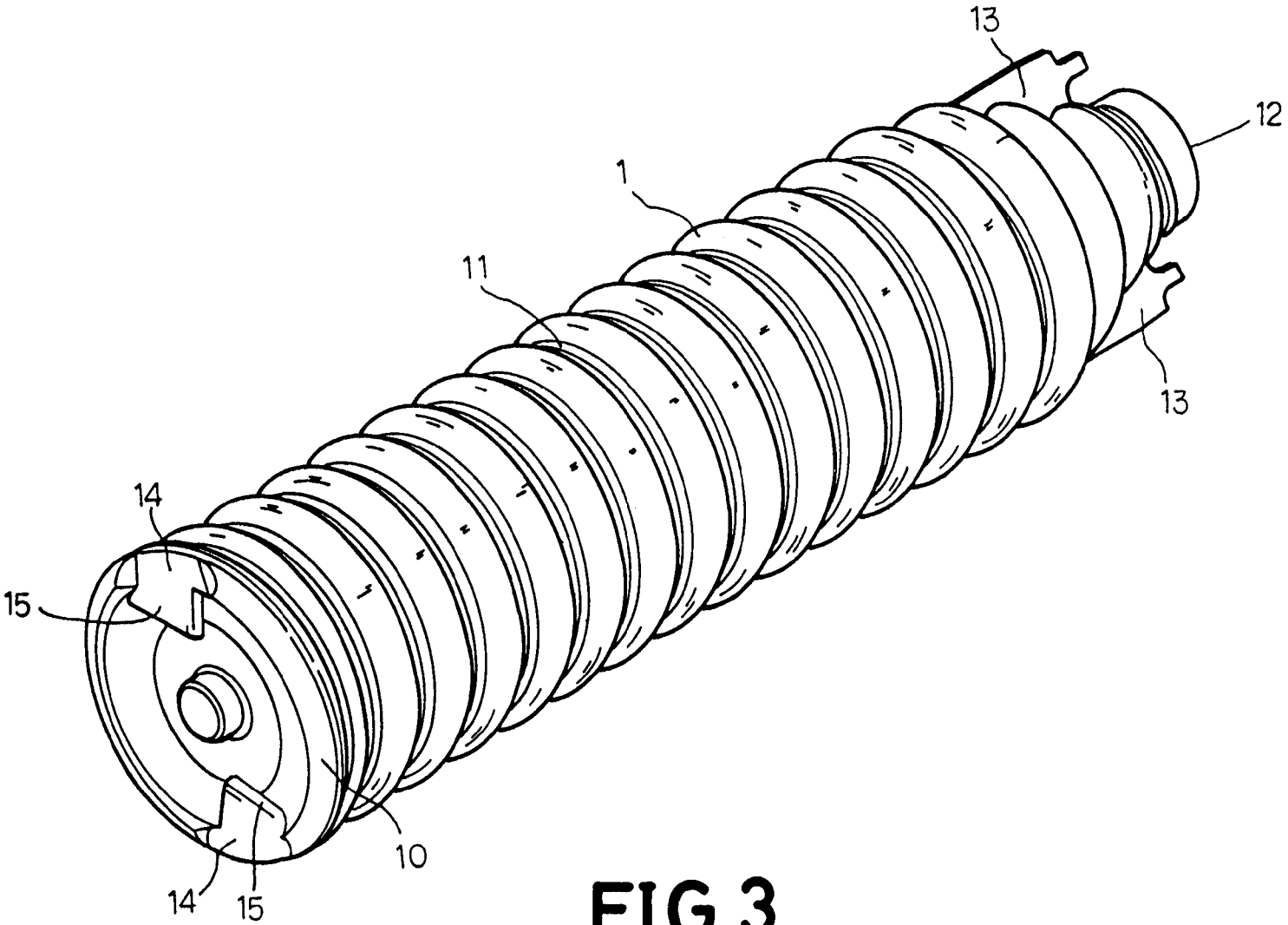
FIG. 3 is a sectional view in an enlarged scale of the front part of the developer container according to the present invention.

Referring to FIG. 3, a developer container in accordance with the present invention comprises a container body 1. The container body 1 comprises a spiral groove 11 extended around the periphery from a front thereof toward a rear end thereof, a developer supply hole 12 at the front end, two protruding positioning strips 13 raised from the periphery at two opposite sides of the developer supply hole 12, an annular flange 10 formed integral with the rear end, two opposed notches 14 formed on the annular flange 10, and two toothed blocks 15 respectively suspended in the notches 14 and extended in direction toward the center of the annular flange 10. By means of the annular flange 10, the container body 1 can be put on a flat surface in vertical, convenient for the loading of developer through the developer supply hole 12 into the inside of the container body 1.

Figure 4:
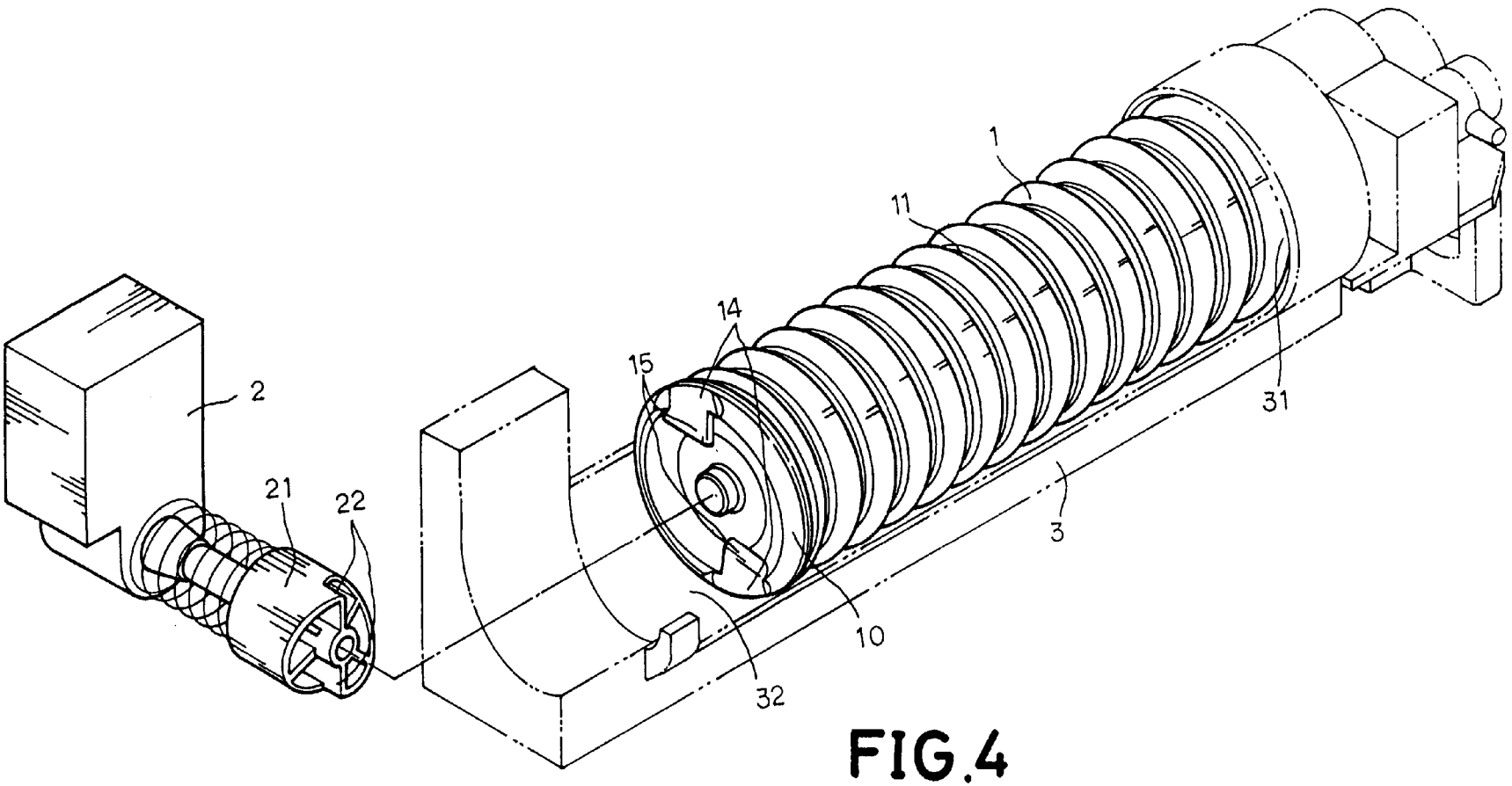
FIG. 4 is similar to FIG. 3 but showing the rotary sealing member rotated to the opening position.

Referring to FIG. 4, when loading in a developer container rack 3, the container body 1 is inserted into the receiving groove 32 at the container rack 3 and set into position inside the electrophotographic image forming apparatus, the toothed blocks 15 are maintained engaged with two toothed blocks 22 at a driving shaft 21, which is coupled to a motor 2. When the motor 2 is started, the driving shaft 21 is rotated by the motor 2, thereby causing the container body 1 to be rotated with the driving shaft 21 to mix developer contained therein.

While only one embodiment of the present invention has been shown and described, it will be understood that various modifications and changes could be made thereunto without departing from the spirit and scope of the invention disclosed.

What the invention claimed is:

1. A developer container adapted for use with a developer replenishing device in an electrophotographic image forming apparatus comprising:

a container body (1) having a spiral groove (11) extended around a periphery thereof from a front end of said container body toward a rear end of said container body, a developer supply hole (12) at the front end, and two protruding positioning strips (13) raised from the periphery at two opposite sides of said developer supply hole (12), wherein said container body (1) further comprises;

an annular flange (10) formed integrally with the rear end to enable said container body (1) to be placed upright on a flat surface standing on the rear end, two notches (14) formed on opposite sides of said annular flange (10), and two toothed blocks (15) respectively suspended in said notches (14) and extended inward toward a center of said annular flange (10), adapted to engage respective toothed blocks (22) on a driving shaft (21) in the electrophotographic image forming apparatus so that said developer container rotates synchronously with the driving shaft (21).

* * * * *